US011192685B2

(12) United States Patent
Park

(10) Patent No.: US 11,192,685 B2
(45) Date of Patent: Dec. 7, 2021

(54) ASSEMBLY TYPE PALLET

(71) Applicant: ALPORTER CO., LTD., Gyeonggi-do (KR)

(72) Inventor: Yong Jae Park, Gyeonggi-do (KR)

(73) Assignee: ALPORTER CO., LTD., Gyeonggi-do (KR)

( * ) Notice: Subject to any disclaimer, the term of this patent is extended or adjusted under 35 U.S.C. 154(b) by 58 days.

(21) Appl. No.: 16/630,149

(22) PCT Filed: Aug. 2, 2017

(86) PCT No.: PCT/KR2017/008333
§ 371 (c)(1),
(2) Date: Apr. 9, 2020

(87) PCT Pub. No.: WO2019/013380
PCT Pub. Date: Jan. 17, 2019

(65) Prior Publication Data

US 2020/0239185 A1 Jul. 30, 2020

(30) Foreign Application Priority Data

Jul. 13, 2017 (KR) ..... 10-2017-0089209

(51) Int. Cl.
*B65D 19/00* (2006.01)

(52) U.S. Cl.
CPC ..... *B65D 19/0093* (2013.01); *B65D 2519/00024* (2013.01); *B65D 2519/00059* (2013.01);
(Continued)

(58) Field of Classification Search
CPC ..... B65D 2519/00368; B65D 2519/00547; B65D 2519/00552; B65D 19/003;
(Continued)

(56) References Cited

U.S. PATENT DOCUMENTS 6,186,077 B1 2/2001 Lim et al.
8,448,582 B2 5/2013 Jian
(Continued)

FOREIGN PATENT DOCUMENTS

CN 104150067 11/2014
EP 3178750 * 6/2017
(Continued)

OTHER PUBLICATIONS

CN109018604 Yue L abstract and figure (Year: 2018).*
(Continued)

*Primary Examiner* — Janet M Wilkens
(74) *Attorney, Agent, or Firm* — Dority & Manning, P.A.

(57) ABSTRACT

An assembly type pallet, includes a plurality of plates having a secure hole on a plate surface, and disposed side by side to each another; a plurality of support frames disposed in a direction intersecting the plates, an inside of the support frame being provided with an inner space along a longitudinal direction, an upper surface of the support frame being provided with a seating surface against which a lower surface of the plates is supported, and the seating surface being provided with an insertion hole communicating with the inner space; a first secure member disposed on the lower surface of the plates and that is provided with an insertion unit which is inserted into the insertion hole of the support frame; and a second secure member inserted into the inner space of the support frame.

12 Claims, 16 Drawing Sheets

(52) U.S. Cl.
CPC ..... *B65D 2519/00094* (2013.01); *B65D 2519/00273* (2013.01); *B65D 2519/00293* (2013.01); *B65D 2519/00323* (2013.01); *B65D 2519/00333* (2013.01); *B65D 2519/00378* (2013.01)

(58) Field of Classification Search
CPC ..... B65D 19/0061; B65D 19/0077; B65D 2519/00333; B65D 2519/00308; B65D 2519/00363; B65D 2519/00393; B65D 2519/00273; B65D 2519/00293; B65D 2519/00323; B65D 19/08; B65D 2519/00024; B65D 2519/00084; B65D 19/0093; B65D 2519/00059; B65D 2519/00094; B65D 2519/00378
USPC ..... 108/56.3, 56.1, 57.17, 57.18, 57.19, 108/57.29, 57.32, 57.3, 3
See application file for complete search history.

(56) References Cited

U.S. PATENT DOCUMENTS

| | | | | |
|---|---|---|---|---|
| 2002/0011194 | A1* | 1/2002 | Lacabanne | B65D 19/0095 108/57.19 |
| 2007/0089647 | A1* | 4/2007 | Vanderlei | B65D 19/0095 108/57.34 |
| 2009/0101049 | A1* | 4/2009 | Lee | B65D 19/0095 108/57.32 |
| 2011/0203491 | A1* | 8/2011 | Poe | B65D 19/0097 108/42 |
| 2012/0298015 | A1* | 11/2012 | Jian | B65D 19/0097 108/56.1 |
| 2016/0001919 | A1* | 1/2016 | Ng | B65D 19/0073 108/51.3 |
| 2017/0152073 | A1* | 6/2017 | Lim | B65D 19/06 |
| 2017/0225826 | A1* | 8/2017 | Xie | B65D 19/0095 |
| 2018/0093795 | A1* | 4/2018 | Chou | B65D 19/0069 |

FOREIGN PATENT DOCUMENTS

| | | | |
|---|---|---|---|
| JP | H09118337 | | 5/1997 |
| JP | 2000229634 | | 8/2000 |
| JP | 3147757 | | 1/2009 |
| JP | 2013216387 | | 10/2013 |
| KR | 100842801 | | 7/2008 |
| KR | 20140041372 | * | 4/2014 |
| KR | 1020160011509 | | 2/2016 |
| KR | 1020170048857 | | 5/2017 |
| WO | WO2009134101 | | 11/2009 |
| WO | 2016000360 | * | 1/2016 |
| WO | 2017069309 | * | 4/2017 |

OTHER PUBLICATIONS

KR20140041372 translation of description (Year: 2014).*
WO2016000360 translation of description (Year: 2016).*
European Search Report for EP17917226.7 dated May 4, 2020, 8 pages.
International Search Report for PCT/KR2017/008333 dated Apr. 10, 2018, 4 pages.

* cited by examiner

ASSEMBLY TYPE PALLET

FIELD

The present invention relates to an assembly type pallet, and more particularly, to an assembly type pallet that may be assembled quickly and firmly using a secure member that may be secured in a simple fitting method.

BACKGROUND

Generally, a pallet is loaded on a transportation means (airplane, ship, vehicle and the like) together with various cargo such as mechanical processed products, assembly components and the like in order to safely transfer the cargo. Therefore, it is more important than anything else to fabricate a pallet that can uphold the cargo safely but that is light at the same time in consideration of the entire load of the cargo.

Such a pallet is composed of multiple abutments that closely contact the bottom, and multiple upper plates that are disposed orthogonally to the abutments such that cargo can be loaded. Conventionally, pallets mainly made of wood have been widely used, but use of plastic pallets are also being proposed.

However, most of all, such pallets made of wood or plastic have heavy load, which increases the entire load of the cargo, thereby consequently leading to a serious problem of causing an increase of logistics cost.

Especially, wood pallets are weak to moisture, thus requiring frequent repair and replacement due to multiple reasons including the connecting parts secured with nails being vulnerable to damage. Further, due to the weak firmness of wood, when loading the wood pallets with loading means such as forklifts and the like, the usability value significantly decreases due to problems such as upper plates being easily breakable, and the short service life due to the weak durability of wood.

Further, plastic pallets have fairly good durability compared to wood pallet, but since a plastic pallet is usually injection-molded as a whole, it is not easy to repair parts of the pallet, and the service life can be significantly reduced.

Meanwhile, in order to resolve the aforementioned problems of conventional pallets, pallets using light material, such as aluminum, have recently been proposed.

Korean Utility Model Registration No. 336053 is one of such a pallet, and its configuration is as illustrated in FIGS. 1 and 2. As illustrated in FIGS. 1 and 2, a conventional pallet is composed of multiple bases 1, multiple upper plates 2 that are bonded on upper surfaces of the bases in a perpendicular direction, multiple abutments 3 that are bonded on bottom surfaces of the bases 1 at certain intervals, and multiple lower plates 4 that are bonded on the bottom surfaces of the abutments and that are parallel to the upper plates.

Here, the abutment 3 has a dual structure of a cap 6 that forms a space inside, and a reinforcement member 7 that is formed in the space of the cap 6 and that may be inserted from an upper part thereof, wherein the bottom surface of the cap 6 and the upper surface of the lower plate 4 are configured in concavo-convex shapes that correspond to each other to be mutually assembled.

Such an aluminum pallet has excellent durability compared to conventional wood or plastic pallets, and somewhat improved assembly firmness, but still has the following problems that need to be improved.

That is, in the aforementioned pallet, the base 1 and the upper plate 2, the upper plate 2 and the base 3, and the base 3 and the lower plate 4 must be assembled using a separate fastening tool such as a driver or a rivet gun, and therefore, requires an onerous assembly process. Therefore, since the pallet cannot be assembled quickly, not only does the assembly productivity falls significantly but a price increase is inevitable. In particular, there is a structural problem that since a plurality of fastening members 8 must be used for each fastening element, the number of assembly operations will increase, and the overall load of the pallet will increase due to excessive use of the fastening members 8, and partial repair of each member becomes almost impossible.

Meanwhile, in the case of assembling the pallet by welding the base and upper plate, abutment and lower plate, the welding increases the thickness of the minimum thickness of the aluminum material, and therefore, not only does the overall load of the pallet increase but expensive materials are wasted and manufacturing costs will increase. Further, welding each of the multiple components by welding requires numerous assembly operations, leading to a problem of increase in manufacturing cost and time.

SUMMARY

Therefore, a purpose of the present disclosure is to resolve the aforementioned problems of prior art, that is, to provide an assembly type pallet that may be assembled quickly and firmly using a secure member that may be secured in a simple fitting method.

Further, another purpose of the present disclosure is to provide an assembly type pallet that may prevent incomplete assembly and prevent random assembly release after being assembled, and that enables easy replacement of some plates or supporting members.

The aforementioned purposes are achieved by an assembly type pallet, including a plurality of plates disposed side by side to each another; a plurality of support frames that are disposed in a direction intersecting the plate to support a lower portion of the plate, an inside of the support frame being provided with an inner space along a longitudinal direction, an upper surface of the support frame being provided with a seating surface against which a lower surface of the plate is supported, and the seating surface being provided with an insertion hole communicating with the inner space; and a first secure member that is disposed on the lower surface of the plate and that is provided with an insertion unit which is inserted into the insertion hole of the support frame to secure the plate to the support frame; and a second secure member that is inserted into the inner space of the support frame to secure the insertion unit of the first secure member to the support frame.

Here, it is desirable that side walls of the support frame contacting the inner space closely contacts both sides of the insertion unit of the first secure member.

Further, it is desirable that the side wall of the support frame is provided with a guiding groove concavely formed along a longitudinal direction and into which one side of the second secure member is inserted, and the insertion unit of the first secure member is provided with an insertion groove concavely formed and into which another side of the second secure member is inserted.

Further, it is desirable that the second secure member is provided with a secure hole that may selectively secure the insertion unit of the first secure member according to a position of the second secure member.

Further, it is desirable that at one side of the secure hole, an insertion area is formed, into which the insertion unit of the first secure member can be penetratingly inserted, and at another side of the secure hole, a secure area is formed, which grips both sides of the insertion unit of the first secure member to secure the insertion unit.

Further, it is desirable that the secure area has a trapezoid shape where a distance between both sides of the secure area gradually decreases.

Further, it is desirable that a side wall of the support frame is provided with a guiding groove that guides movement of the second secure member.

Further, it is desirable that both sides of the insertion unit are provided with an insertion groove along a longitudinal direction of the second secure member, and the secure area is provided with a secure protrusion inserted into the insertion groove.

Further, it is desirable that the second secure member extends along the longitudinal direction of the support frame to simultaneously secure a plurality of first secure members being inserted into the support frame.

Further, it is desirable that the plate is provided with a penetration hole through which the first secure member penetrates, and a rear end of the insertion unit of the first secure member is provided with a head that is supported against the plate.

Further, it is desirable that an upper surface of the plate is provided with a concave groove that is concavely formed and into which the head of the first secure member is accommodated, and both sides of the concave groove closely contact both sides of the head.

Further, it is desirable that the insertion unit and the head are formed separately, the head is inserted into and supported against the concave groove provided in the plate, and the insertion unit penetrates the penetration hole of the plate and is assembled to the head.

Further, it is desirable that the concave groove is formed along the longitudinal direction of the plate inside the plate.

According to the present disclosure, there is provided an assembly type pallet that may be assembled quickly and firmly using a secure member that may be secured in a simple fitting method.

Further, there is provided an assembly type pallet that may prevent incomplete assembly and prevent random assembly release after being assembled, and that enables easy replacement of some plates or supporting members.

DETAILED DESCRIPTION

Prior to describing the present disclosure, it is to be noted that in numerous embodiments, components having the same configuration will be described in the first embodiment as a representative, and in other embodiments, configurations other than the first embodiment will be described.

Hereinafter, an assembly type pallet according to a first embodiment of the present disclosure will be described in detail with reference to the attached drawings.

Figure 1:
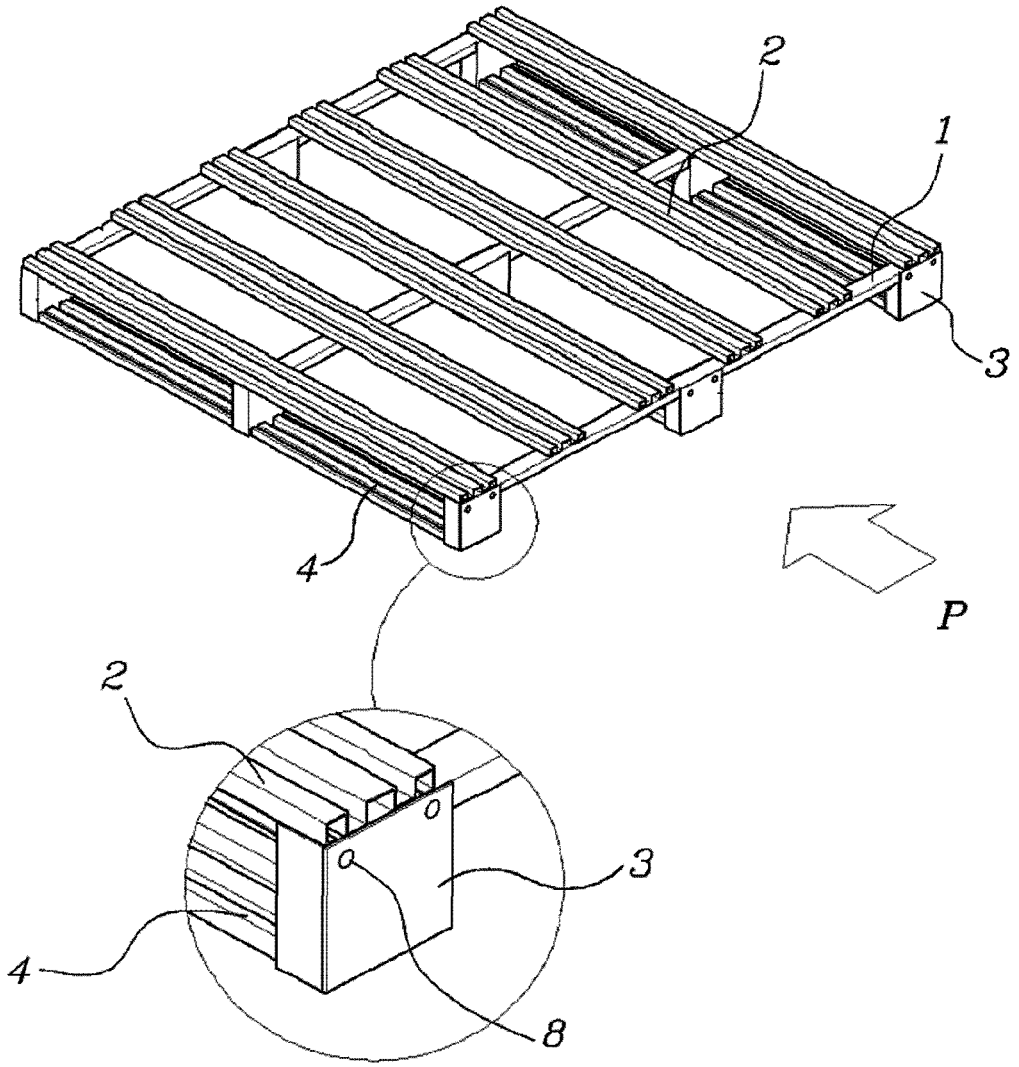
FIG. 1 Prior Art
FIG. 1 is an exterior perspective view of a conventional pallet implementation structure.
Figure 2:
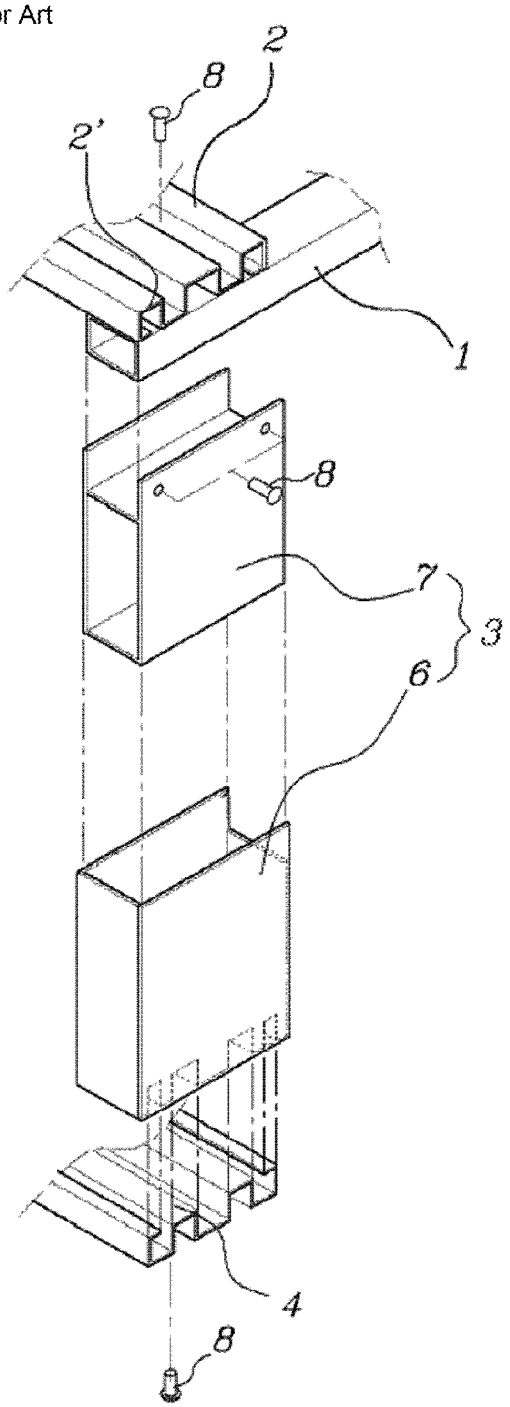
FIG. 2 Prior Art
FIG. 2 is an exploded perspective view of main parts of FIG. 1.
Figure 3:
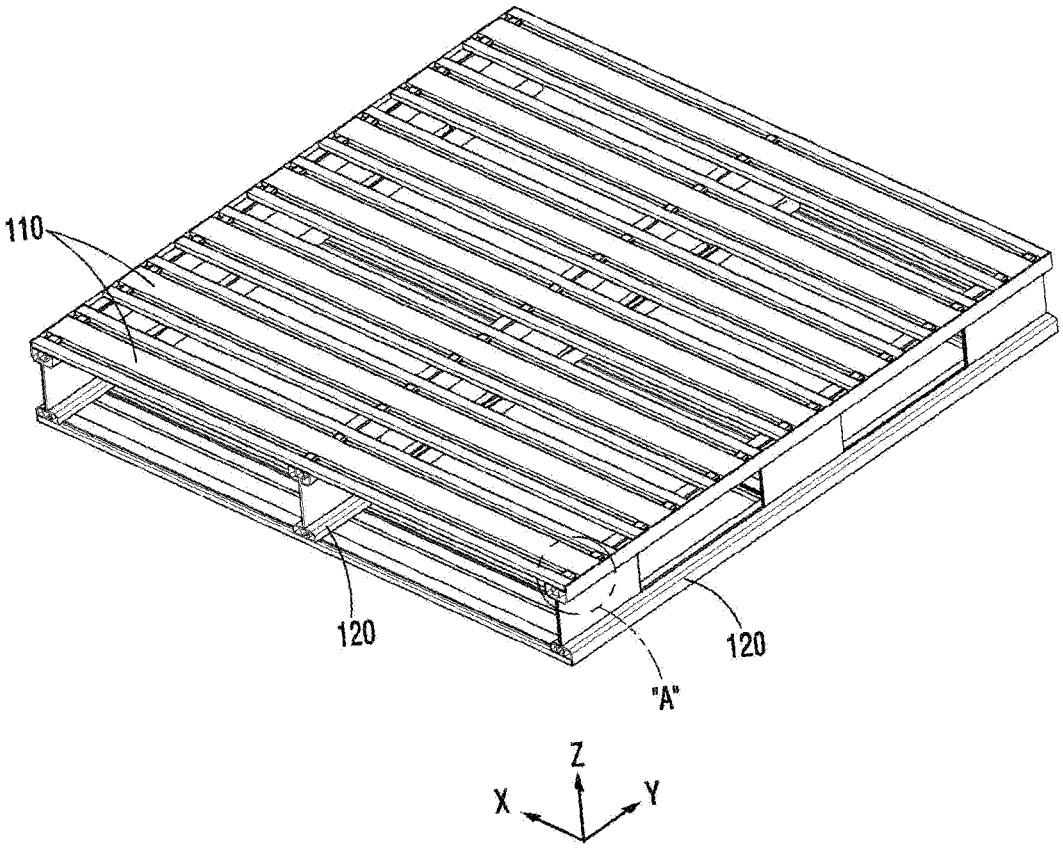
FIG. 3 is a perspective view of an assembly type pallet according to a first embodiment of the present disclosure.
Figure 4:
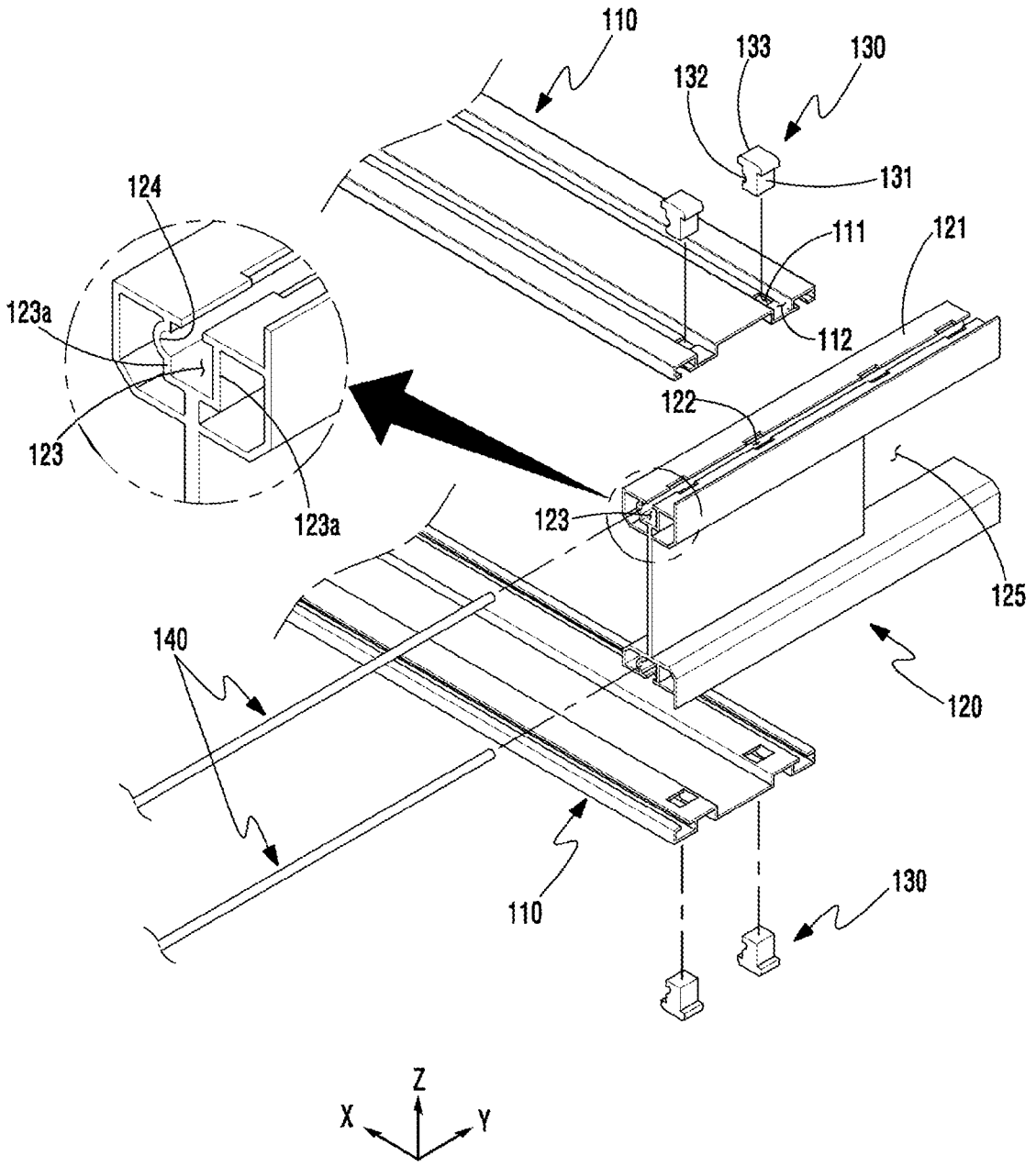
FIG. 4 is an exploded perspective view of part "A" of FIG. 3.

Of the attached drawings, FIG. 3 is a perspective view of an assembly type pallet according to a first embodiment of the present disclosure, and FIG. 4 is an exploded perspective view of part "A" of FIG. 3.

The assembly type pallet according to a first embodiment of the present disclosure as illustrated in the aforementioned drawings is composed of a plate 110, a support frame 120, a first secure member 130 and a second secure member 140.

In the present embodiment, for convenience of description, it is to be noted that the direction in which the plate 110 extends is a first axis X, the direction in which the support frame 120 extends is a second axis Y, and the direction in which the first secure member 130 is inserted/separated is a third axis Z.

The plate 110 is provided in plurality and are disposed parallel to one another. The plate 110 is composed of a plate type longitudinal member of a light metal material such as aluminum, and a plurality of penetration holes 111 are penetratingly formed in a vertical direction on a portion where it intersects the support frame 120, and a concave groove 112 having a "⊏" shape cross-section is concavely formed along a longitudinal direction on an upper side of the plate. Such a plate 110 is illustrated to be disposed above the support frame 120 and below the support frame 120, respectively, but the plate 110 may be disposed on only the upper surface of the support frame 120, instead.

The support frame 120 is disposed in a direction intersecting the plate 110 to support the lower portion of the plate 110. The support frame 120 may be provided in plurality in order to prevent the deflection of the plate 110 and be disposed at intervals along the longitudinal direction of the plate 110. An upper surface of the support frame 120 is provided with a seating surface 121 against which a lower surface of the plate 110 is closely supported, and an insertion hole 122 which communicates with an inner space 123 of the support frame 120 is formed on the seating surface 121 to which the penetration hole 111 corresponds.

The inner space 123 is set to have a same width as an insertion unit 131 of the first secure member 130 such that side walls 123*a* of the support frame 120, contacting the inner space 123, may closely contact both sides of the insertion unit 131 of the first secure member 130. Further, at the side wall 123*a* of the support frame 120, a guiding groove 124 into which one side of the second secure member 140 may be inserted, is concavely formed along a longitudinal direction.

Meanwhile, it is desirable that at one side of the support frame 120, a fork insertion space 125 is formed, and that the side wall 123*a* of the inner space 123 is composed of a dual wall so as to prevent the side wall 123*a* surrounding the inner space 123 from being damaged in the process of moving the pallet using a fork.

The first secure member 130 includes the insertion unit 131 that may be inserted into the penetration hole 111 and the insertion hole 122 of the plate 110, to secure the plate 110 to the support frame 120, and a head 133 that is provided at a rear end of the insertion unit 131, to be supported against a plate surface of the plate 110. Further, sides of the insertion unit 131 has a side that corresponds to the side wall 123*a* having the guiding groove 124, and the side corresponding to the side wall is provided with an insertion groove 132 into which another side of the second secure member 140 may be inserted and which is concavely formed along the longitudinal direction of the support frame 120.

Figure 5:
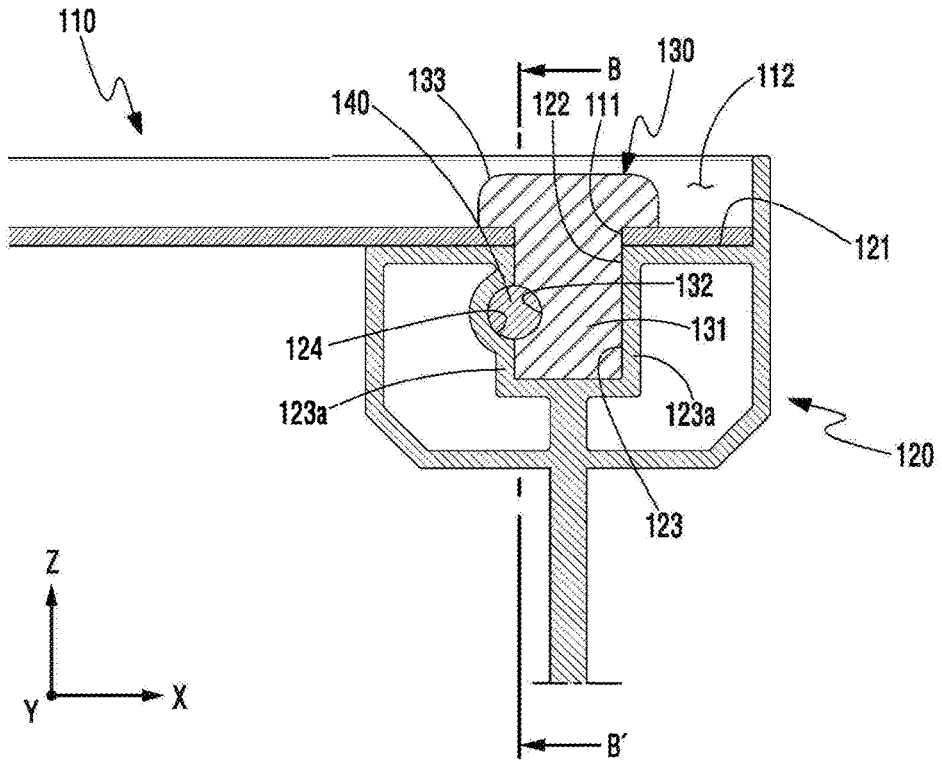
FIG. 5 is a cross-sectional view of part "A" of FIG. 3.

Here, one side of the second secure member 140 refers to one side area from a center of a cross-section of the second secure member 140, and another side of the second secure member 140 refers to another area from the center of the cross-section of the second secure member 140 (see FIG. 5).

In such a first secure member 130, both sides of the insertion unit 131 of the first secure member 130 closely contact the side walls 123*a* that contacts the inner space 123 of the support frame 120, and both sides of the head 133 closely contact both sides of the concave groove 112 of the plate 110. Here, the both sides of the insertion unit 131 are disposed in a parallel direction with the support frame 120, and the both sides of the head 133 are disposed in a parallel direction with the plate 110, and thus not only does this prevent movement towards the first axis X direction and the second axis Y direction in a state where the first secure member 130 is assembled, but the penetration hole 111 and the insertion hole 122 are also prevented from being damaged by external force.

When the second secure member 140 is inserted along the guiding groove 124 of the side wall 123*a* contacting the inner space 123 of the support frame 120, the second secure member 140 is inserted into the insertion groove 132 of the first secure member 130, to prevent the first secure member 130 from being dislocated towards the insertion side, and the second secure member 140 is formed in a bar form that extends in the longitudinal direction of the support frame 120, so that the multiple first secure members 130 being inserted into the support frame 120 can be secured at the same time.

Meanwhile, in the present embodiment, it was described that the second secure member 140 is formed in a bar shape having a circular cross-section, and that each of the guiding groove 124 and the insertion groove 132 has a groove shape with a semicircular cross-section, but there is no limitation thereto, and in the case where the second secure member 140 has a bar shape with a square cross-section, each of the guiding groove 124 and the insertion groove 132 may be formed in a groove shape that divides the cross-section of the second secure member 140 in a vertical direction.

Hereinafter, operations of a first embodiment of the aforementioned assembly type pallet will be described.

Figure 6:
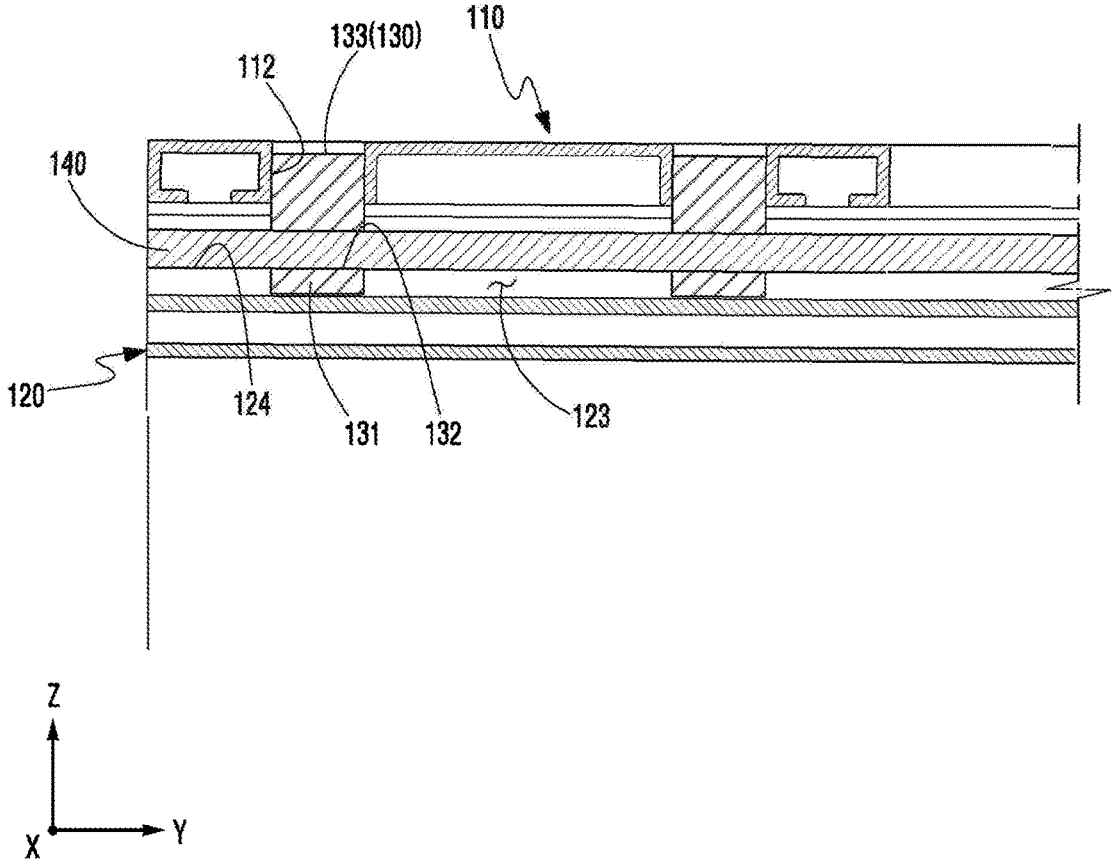
FIG. 6 is a cross-sectional view of FIG. 5 cut along line B-B'.
Figure 7:
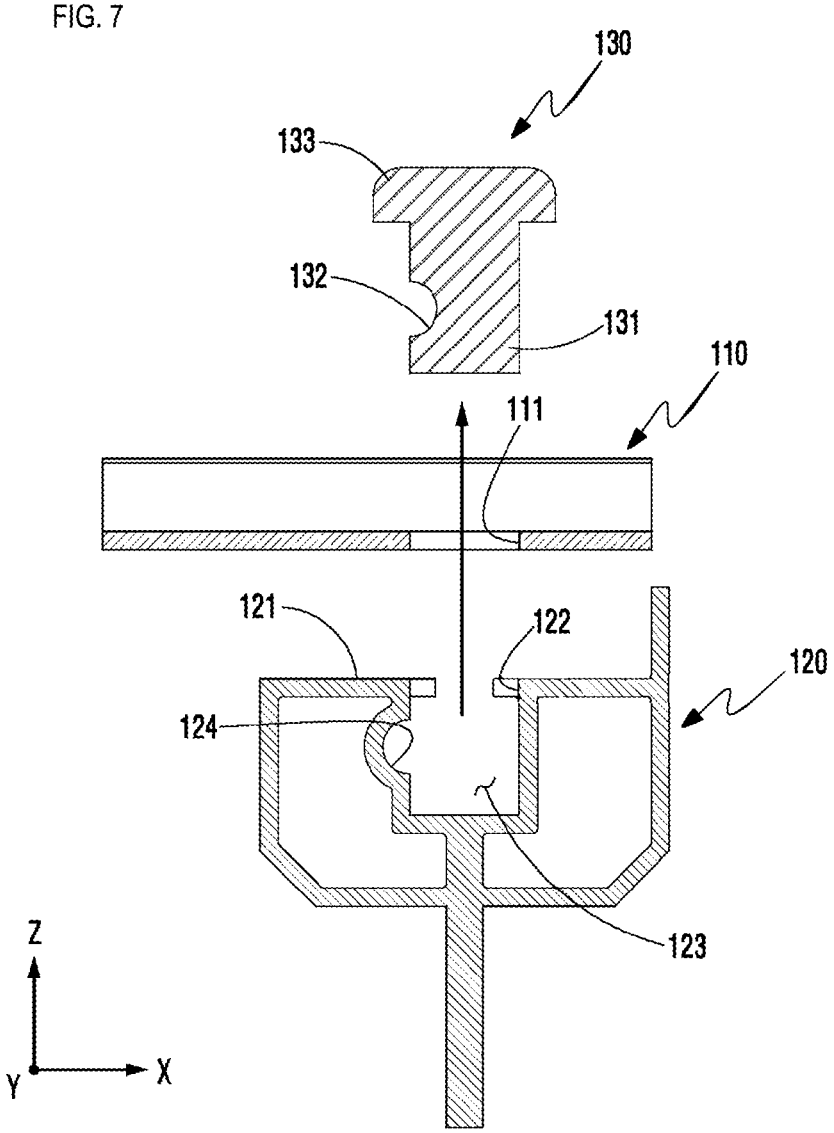
FIG. 7 is a function cross-sectional view illustrating a process of separating a first secure member with a second secure member removed according to a first embodiment of the present disclosure.

Of the attached drawings, FIG. 5 is a cross-sectional view of part "A" of FIG. 3, FIG. 6 is a cross-sectional view of FIG. 5 cut along line B-B', and FIG. 7 is a function cross-sectional view illustrating a process of separating the first secure member 130 with the second secure member removed according to a first embodiment of the present disclosure.

As illustrated in FIGS. 5 and 6, as the plate 110 is disposed in a first axis direction and the support frame 120 is disposed in a second axis direction, the plate 110 and the support frame 120 intersect each other, and the lower surface of the plate 110 is closely supported against the seating surface 121 of the support frame 120.

Regarding the first secure member 130 that secures the plate 110 and the support frame 120, when the insertion unit 131 of the first secure member 130 is inserted into the inner space 123 via the penetration hole 111 of the plate 110 and the insertion hole 122 of the support frame 120, the head 133 provided at the rear end of the insertion unit 131 is supported against the upper side of the plate 110, thus guiding the insertion position of the first secure member 130.

Here, the head 133 is accommodated within the concave groove 112 provided at the upper side of the plate 110, and thus it is possible to prevent objects being loaded from stumbling over the head 133 in the process of loading or moving the objects to the upper side of the plate 110.

Further, the first secure member 130 closely contacts the side wall 123*a* where both sides of the insertion unit 131 contact the inner space 123 of the support frame 120, and both sides of the head 133 closely contact both sides of the concave groove 112 of the plate 110. That is, since both sides of the insertion unit 131 closely contacting the side wall 123*a* are side by side with the second axis, and both sides of the head 133 closely contacting both sides of the concave groove 112 are side by side with the first axis, the external force being applied in the first axis direction is distributed and supported against the side wall 123*a* of the support frame 120, and the external force being applied in the second axis direction is distributed and supported against the side of the concave groove 112.

The insertion unit 131 of the first secure member 130 inserted into the inner space 123 of the support frame 120 is limited from moving towards the third axis direction by the second secure member 140 which is inserted into the guiding groove 124 formed on the side wall 123*a* contacting the inner space 123 of the support frame 120 and into the insertion groove 132 formed on the insertion unit 131 of the first secure member 130, and thus the first secure member 130 may be prevented from being randomly separated.

The second secure member 140 extends in the longitudinal direction of the support frame 120. Therefore, by pushing one second secure member 140 into the guiding groove 124, the multiple first secure members 130 which secures the multiple plates 110 to the support frame 120 can be secured all at once.

Further, in a state where the multiple first secure members 130 are secured using one second secure member 140, external force is applied to the second secure member 140 in various directions, and thus the second secure member 140 is prevented from being randomly dislocated from the guiding groove 124.

Meanwhile, as illustrated in FIG. 7, in a state where the support frame 120 and the second secure member 140 for securing the first secure member 130 are separated from each other, it is possible to separate the insertion unit 131 of the first secure member 130 that has been inserted into the inner space 123 through the penetration hole 111 and the insertion hole 122, by pulling in the third axis direction. Further, when the first secure member 130, that secures the support frame 120 and the plate 110, is separated, it becomes possible to separate the plate 110 from the support frame 120.

Therefore, it is possible to assemble in a simple fitting method and to maintain the assembled state firmly at the same time, and when the second secure member 140 is separated, the plate 110 may be easily separated from the support frame 120, and thus it is possible to easily replace or repair and maintain the plate 110 being damaged or deformed by impact with the loaded objects.

Next, an assembly type pallet according to a second embodiment of the present disclosure will be described.

Figure 8:
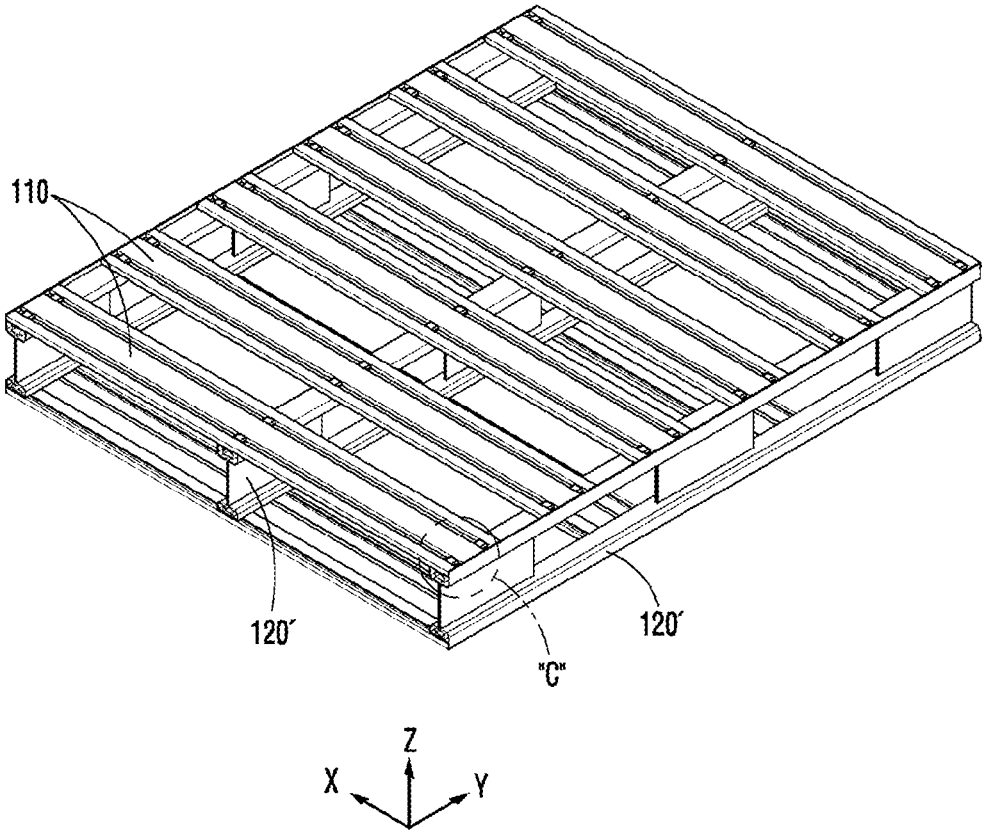
FIG. 8 is a perspective view of an assembly type pallet according to a second embodiment of the present disclosure.
Figure 9:
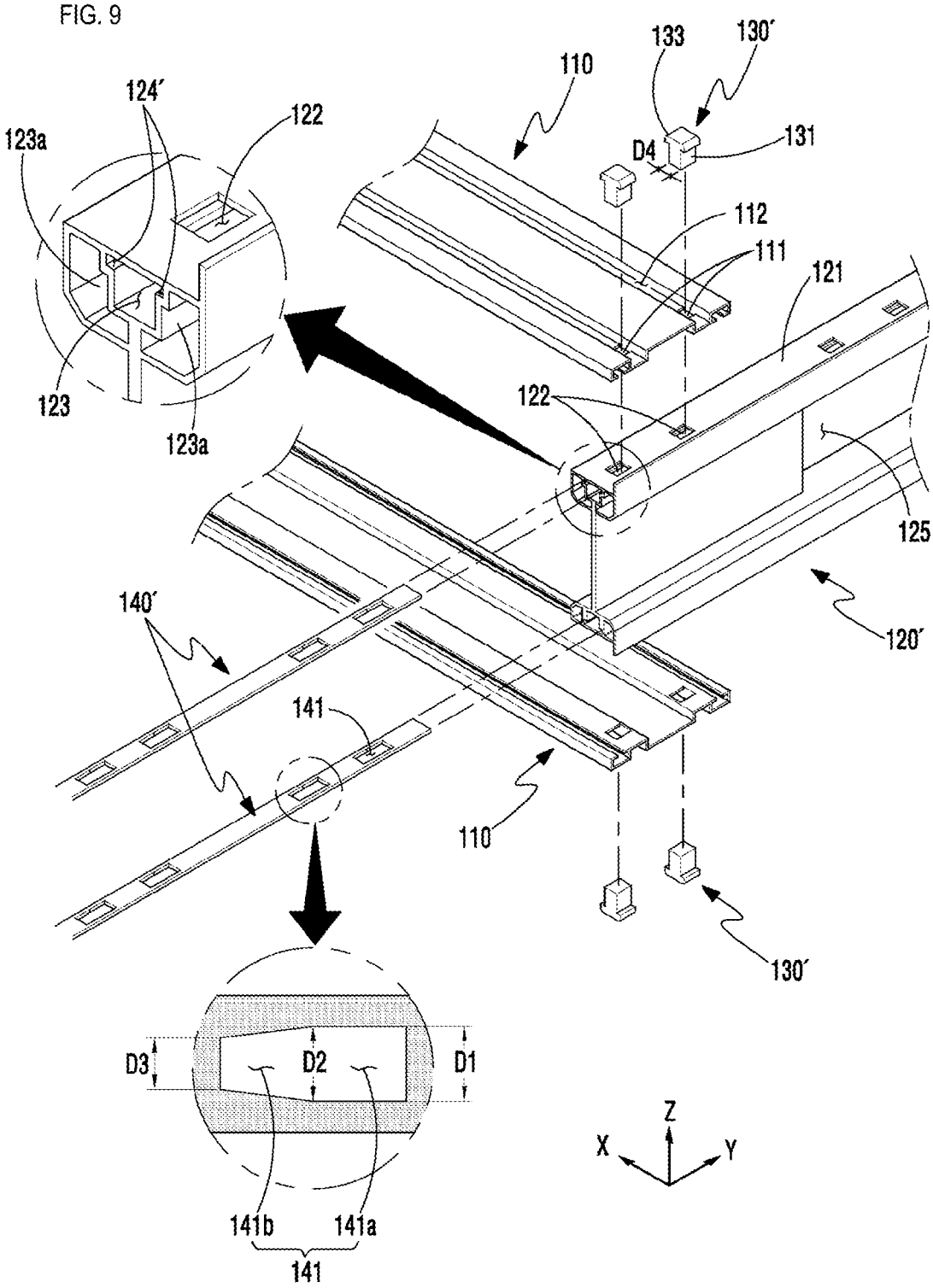
FIG. 9 is an exploded perspective view of part "C" of FIG. 8.

Of the attached drawings, FIG. 8 is a perspective view of an assembly type pallet according to a second embodiment of the present disclosure, and FIG. 9 is an exploded perspective view of part "C" of FIG. 8.

The assembly type pallet according to a second embodiment of the present disclosure as illustrated in the aforementioned drawings, is configured to include a plate 110, a support frame 120, a first secure member 130' and a second secure member 140'.

The plate 110 is provided in plurality and are disposed parallel to one another. The plate 110 is composed of a plate type longitudinal member of a light metal material such as aluminum, and a plurality of penetration holes 111 are penetratingly formed in a vertical direction on a portion where it intersects the support frame 120, and a concave groove 112 having a "⊏" shape cross-section is concavely formed along a longitudinal direction on an upper side of the plate. Such a plate 110 is illustrated to be disposed above the support frame 120' and below the support frame 120, respectively, but the plate 110 may be disposed on only the upper surface of the support frame, instead.

The support frame 120' is disposed in a direction intersecting the plate 110, to support the lower portion of the plate 110. The support frame 120' may be provided in plurality in order to prevent the deflection of the plate 110 and may be disposed at intervals along the longitudinal direction of the plate 110. An upper surface of the support frame 120' may be provided with a seating surface 121, against which a lower surface of the plate 110 is closely supported, and at a position of the seating surface 121 that corresponds to the penetration hole 111, an insertion hole 122 may be formed, that communicates with an inner space 123 of the support frame 120.

On side walls 123*a* of the support frame 120' contacting the inner space 123, a guiding groove 124' is formed in a longitudinal direction to cover both sides of the second secure member 140' in order to guide the movement of the second secure member 140' in a second axis Y direction.

Meanwhile, at one side of the support frame 120, a fork insertion space 125 may be formed, and it is desirable that the side wall 123*a* of the inner space 123 is composed of a dual wall, so as to prevent the side wall 123*a* surrounding the inner space 123 from being damaged in the process of moving the pallet using a fork.

The first secure member 130' includes an insertion unit 131 that is inserted into the penetration hole 111 of the plate 110 and into the insertion hole 122 of the support frame 120' to secure the plate 110 to the support frame 120', and the head 133 provided at a rear end of the insertion unit 131 to be supported against a plate surface of the plate 110.

In such a first secure member 130', both sides of the insertion unit 131 closely contact the side wall 123*a* contacting the inner space 123 of the support frame 120', and both sides of the head 133 closely contact both sides of the concave groove 112 of the plate 110. Here, both sides of the insertion unit 131 are disposed in a direction side by side with the support frame 120', and both sides of the head 133 are disposed in a direction side by side with the plate 110, and thus not only is it possible to prevent movement towards the first axis X direction and second axis Y direction with the first secure member 130' assembled, but the penetration hole 111 and the insertion hole 122 are prevented from being damaged by external force.

When the second secure member is inserted along the guiding groove 124' formed on the side wall 123*a* contacting the inner space 123 of the support frame 120', the second secure member 140' secures the insertion unit 131 of the first secure member 130' to prevent the first secure member 130' from being dislocated towards the insertion side, and the second secure member 140' is formed in a bar form with a square cross-section, that extends in the longitudinal direction of the support frame 120', so that the multiple first secure members 130' being inserted into the support frame 120' can be secured at the same time.

Specifically, on the plate surface of the second secure member 140', a secure hole 141 is formed that may selectively secure the insertion unit 131 of the first secure member 130' according to the second axis direction position of the second secure member 140', and at one side of the secure hole 141, an insertion area 141*a* is formed, where the insertion unit 131 of the first secure member 130' may be penetratingly inserted in the third axis Z direction, and at another side of the secure hole 141, a secure area 141*b* is formed, where the insertion unit 131 of the first secure member 130' may be secured. That is, a width D1 of the insertion area 141*a* is set to be the same as a width D4 of the insertion unit 131 or to an extent that the insertion unit 131 can be inserted, and a width D2 at one side being connected with the insertion area 141*a* of the secure area 141*b* is set to be the same as the width D1 of the insertion area 141*a*, and a width D3 at another side located at an opposite side of the insertion area 141*a* is set to be smaller than the width D4 of the insertion unit 131.

Meanwhile, in the present embodiment, it was described as an example that the secure area 141*b* has a trapezoid shape where a distance between both sides of the secure area 141*b* gradually decreases, and when the insertion unit 131 of the first secure member 130' is disposed in the secure area 141*b* by the second secure member 140' moving in the longitudinal direction, both sides of the secure hole 141 grip and secure both sides of the insertion unit 131 in the form of pressurizing, but it will also be possible to form, at one side of the insertion unit 131, along the longitudinal direction of the support frame 120', an insertion groove into which the second secure member 140' may be inserted.

Hereinafter, operations of the second embodiment of the aforementioned assembly type pallet will be described.

Figure 10:
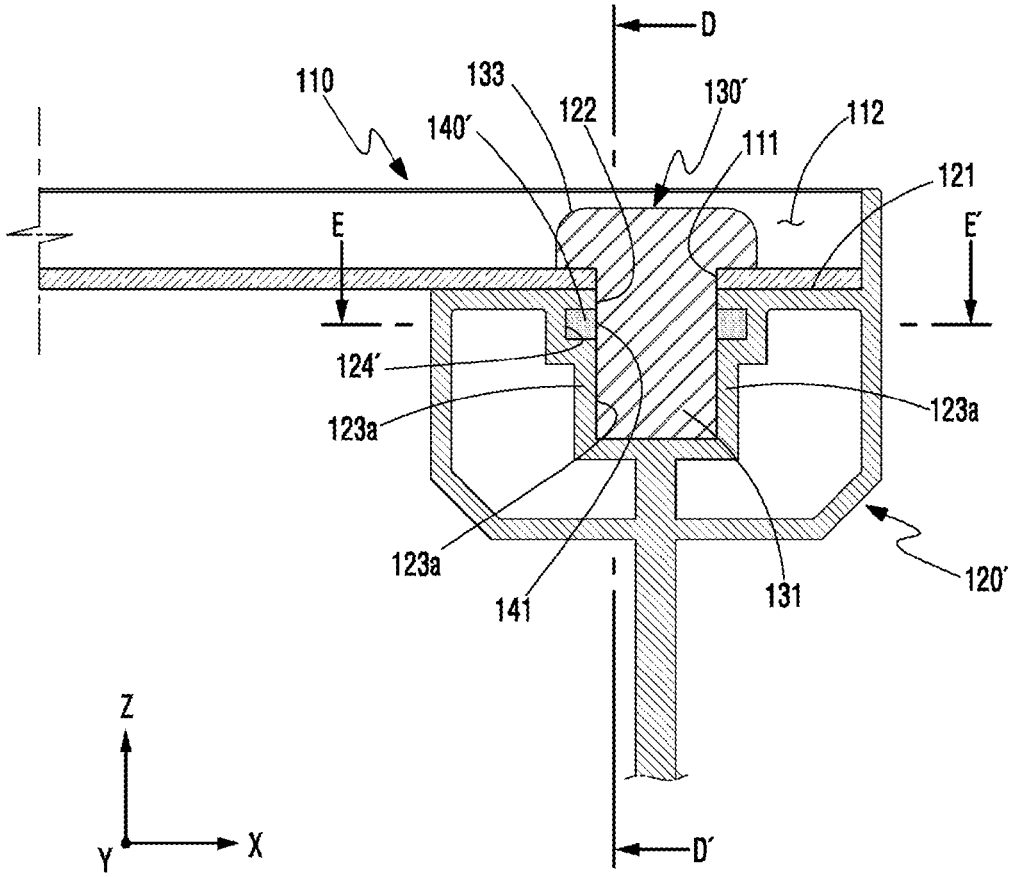
FIG. 10 is a cross-sectional view of part "C" of FIG. 8.
Figure 11:
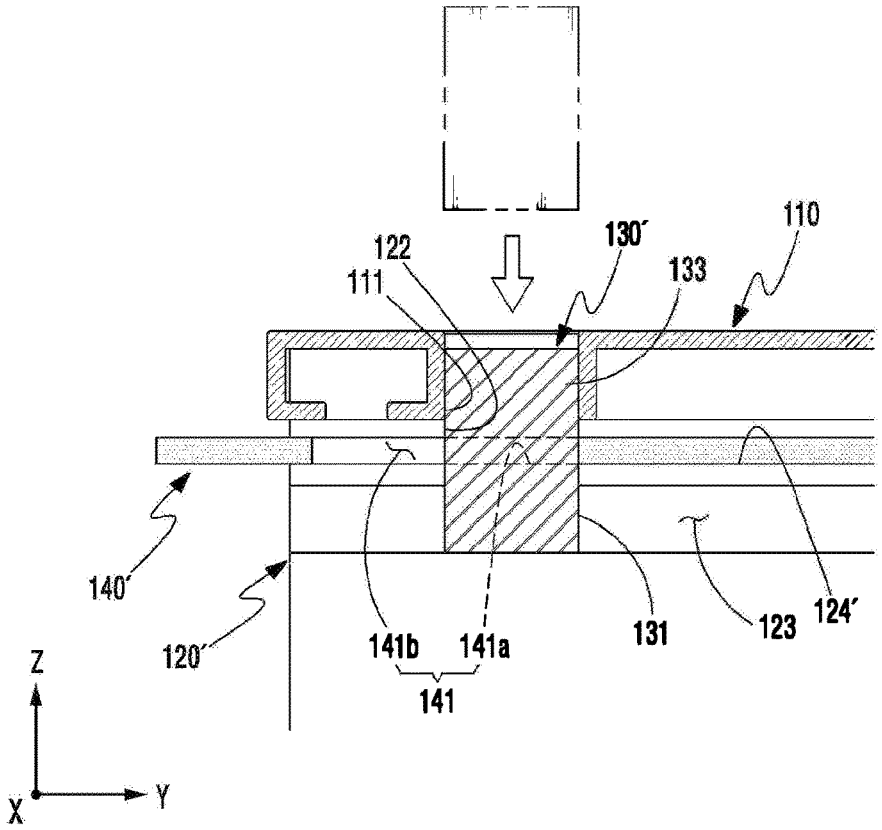
FIGS. 11 to 12 are views illustrating a state where the second secure member has moved to a release position according to a second embodiment of the present disclosure.
Figure 12:
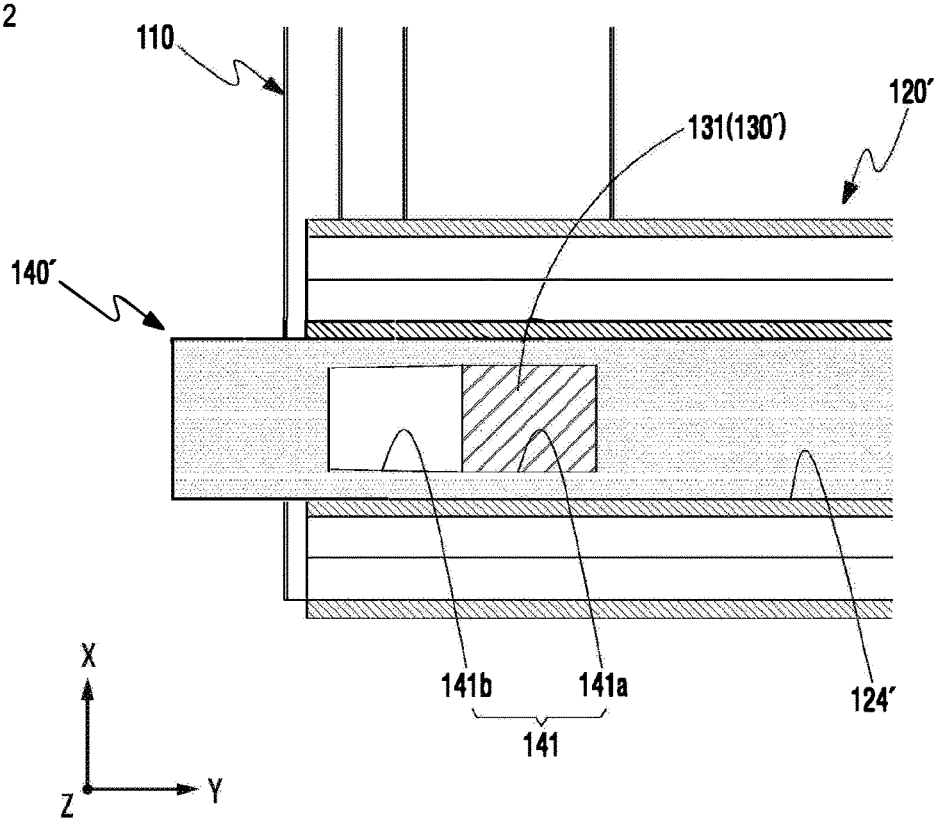
Figure 13:
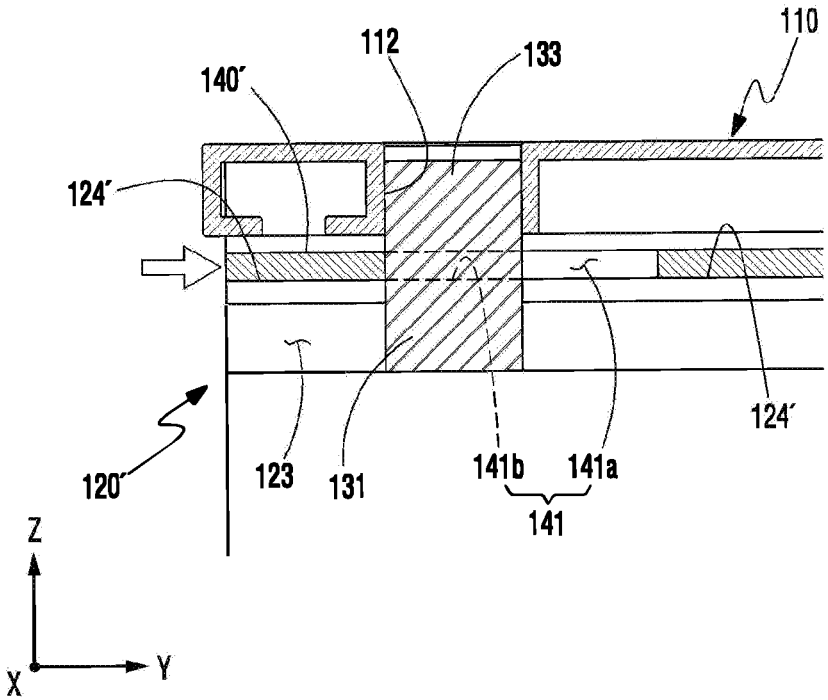
FIGS. 13 to 14 are views illustrating a state where the second secure member has moved to a secure position according to a second embodiment of the present disclosure.
Figure 14:
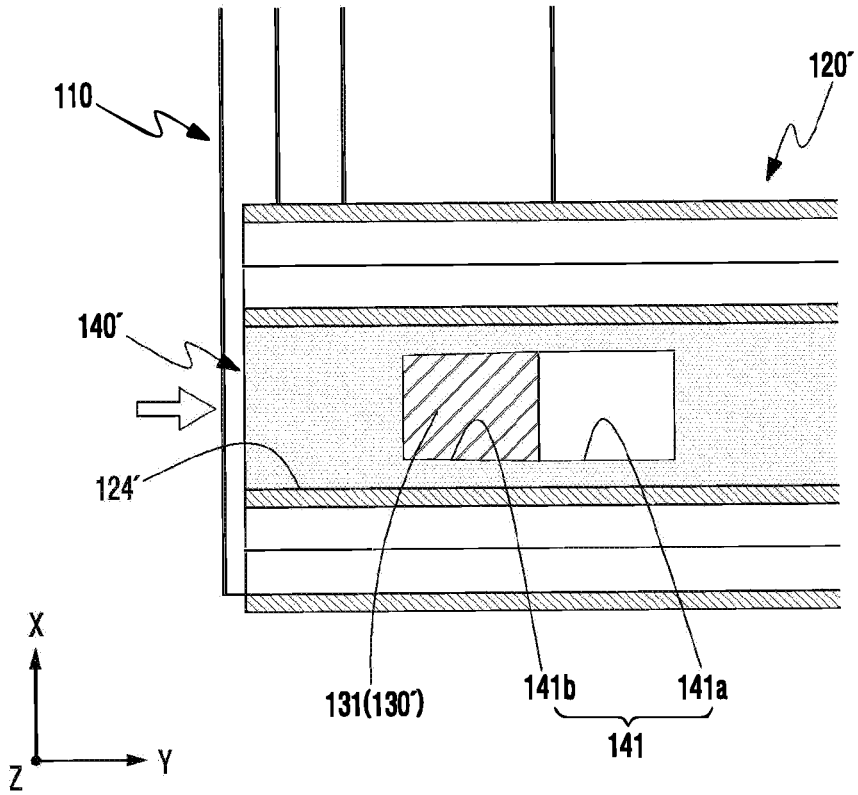

Of the attached drawings, FIG. 10 is a cross-sectional view of part "C" of FIG. 8, FIGS. 11 to 12 are views illustrating a state where the second secure member moved to a release position according to a second embodiment of the present disclosure, and FIGS. 13 and 14 are views illustrating a state where the second secure member moved to a secure position according to a second embodiment of the present disclosure.

As illustrated in FIG. 10, the plate 110 is disposed in the first axis direction and the support frame 120' is disposed in the second axis direction at a lower portion of the plate 110, to intersect the plate 110, and a lower surface of the plate 110 is closely supported against the seating surface 121 of the support frame 120'.

The second secure member 140' is inserted along the guiding groove 124' formed at both sides of the inner space 123 of the support frame 120', and the insertion unit 131 of the first secure member 130' penetrates the penetration hole 111 of the plate 110, the insertion hole 122 of the support frame 120' and the secure hole 141 of the second secure member 140', to be inserted into the inner space 123 of the support frame 120', and the head 133 provided at a rear end of the insertion unit 131 is supported against the upper side of the plate 110, thereby guiding the insertion position of the first secure member 130'.

The first secure member 130' inserted in the third axis direction as aforementioned is prevented from being dislocated towards the insertion side, as both sides of the insertion unit 131 fall into a state where they are fitted to the secure hole 141 of the second secure member 140'. Therefore, by assembling the first secure member 130' and the second secure member 140' in a simple fitting form, it is possible to have the assembled state of the plate 110 and the support frame 120' maintained firmly.

Hereinafter, a process of assembling the first secure member 130' and the second secure member 140' will be described.

First of all, FIG. 11 illustrates a cross-sectional view of FIG. 10 cut along line D-D', and FIG. 12 illustrates a cross-sectional view of FIG. 10 cut along line E-E'. As illustrated in FIGS. 11 and 12, a lower surface of the plate 110 disposed in a direction intersecting the support frame 120' rests on an upper side seating surface 121 of the support frame 120' and in a state where the penetration hole 111 of the plate 110 is connected with the insertion hole 122 of the support frame 120', with the second secure member 140' inserted along the guiding groove 124' of the support frame 120' to be moved to a release position, the insertion area 141*a* of the secure hole 141 falls into a state of being connected with the penetration hole 111 and the insertion hole 122.

In a state where the second secure member 140' has moved to the release position as aforementioned, it becomes possible to insert the insertion unit 131 of the first secure member 130' into the penetration hole 111, the insertion hole 122 and the insertion area 141*a*.

Next, as illustrated in FIGS. 13 and 14, since the secure area 141*b* is connected at one side of the insertion area 141*a* of the secure hole 141, it is possible to pressurize the second secure member 140' in the second axis direction to move the second secure member 140' to the secure position.

That is, when the second secure member 140' is moved to the secure position, the insertion area 131 of the first secure member 130' is positioned within the secure area 141*b* of the secure hole 141. Here, since the width of the secure area 141*b* is set to be smaller than the width of the insertion unit 131 of the first secure member 130', both sides of the secure hole 141 contacting the secure area 141*b* are press-fit into both sides of the insertion unit 131, thus preventing the first secure member 130' from being separated towards the insertion side.

Meanwhile, separation of the first secure member 130' and the second secure member 140' is conducted in a reverse-assembly sequence, and thus detailed description thereof will be omitted.

Next, an assembly type pallet according to a third embodiment of the present disclosure will be described.

Figure 15:
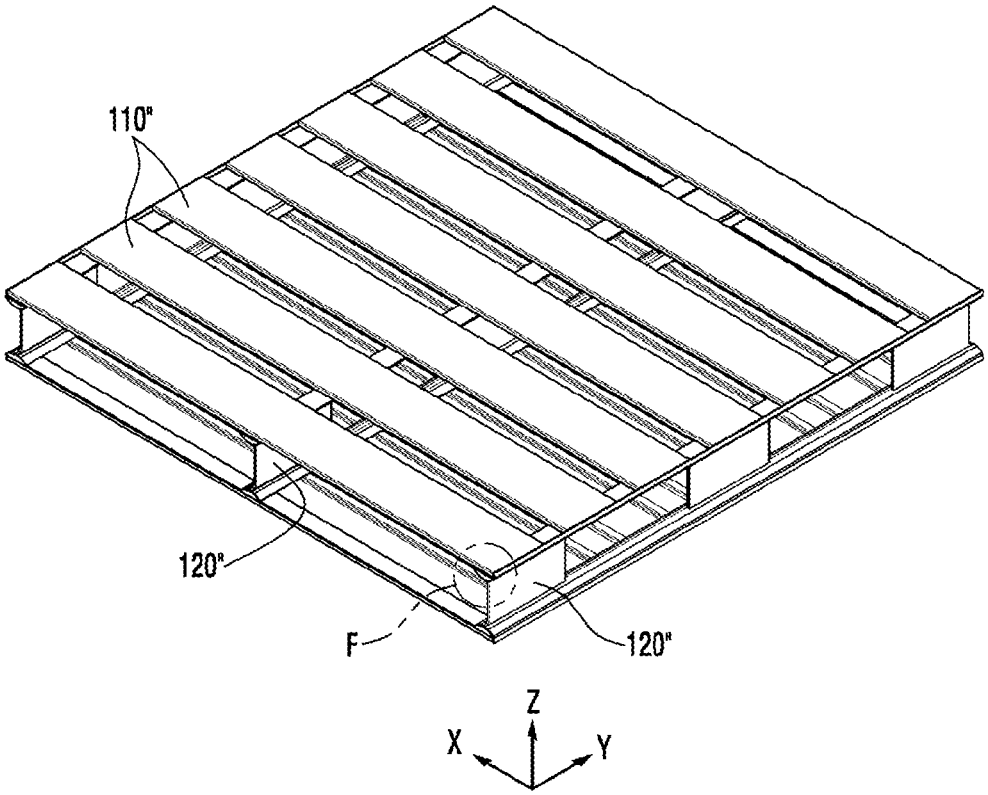
FIG. 15 is a perspective view of an assembly type pallet according to a third embodiment of the present disclosure.
Figure 16:
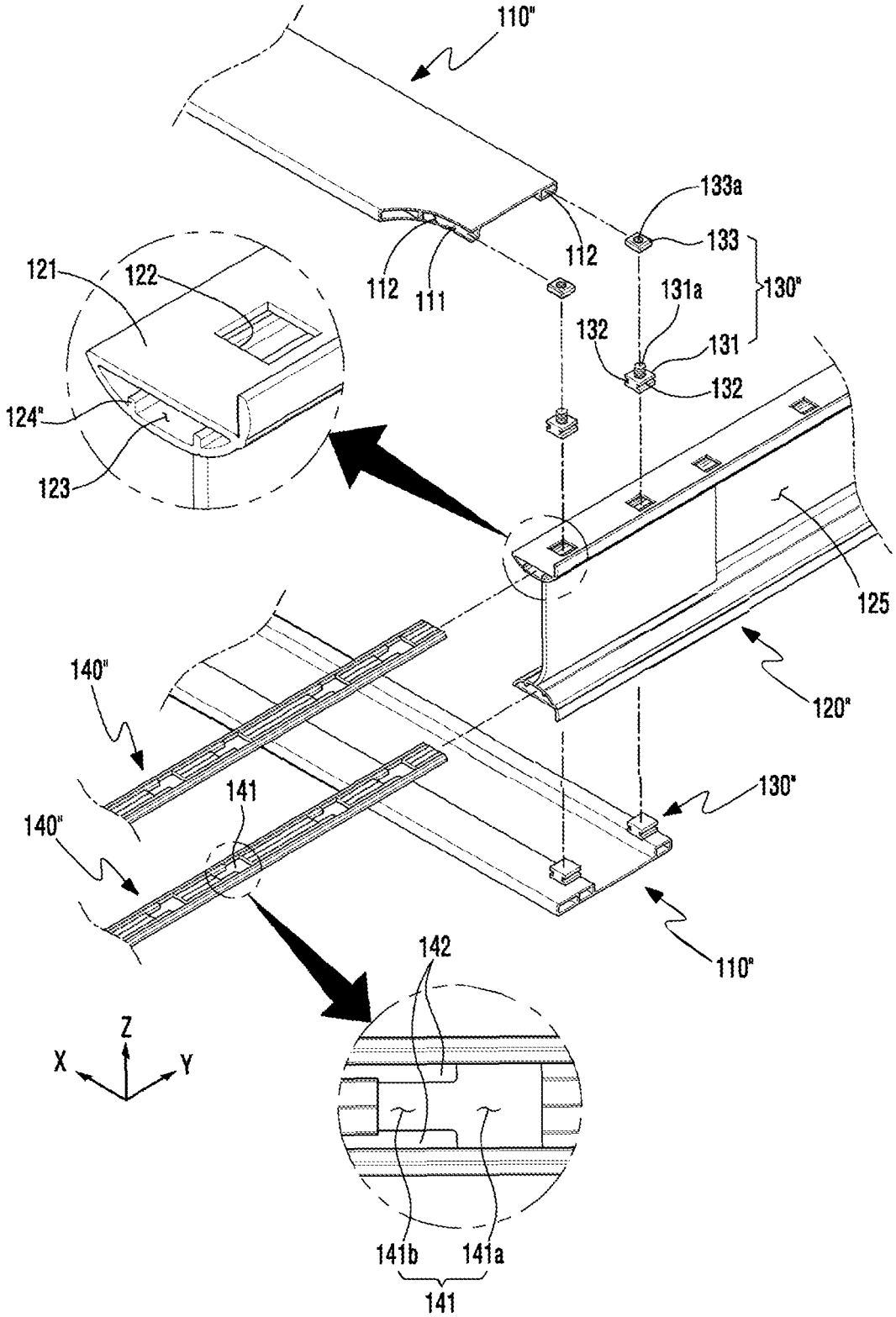
FIG. 16 is an exploded perspective view of part "F" of FIG. 15.

Of the attached drawings, FIG. 15 is a perspective view of an assembly type pallet according to a second embodiment of the present disclosure, and FIG. 16 is an exploded perspective view of part "D" of FIG. 15.

The assembly type pallet according to a third embodiment of the present disclosure as illustrated in the aforementioned drawings is composed of a pallet 110", a support frame 120", a first secure member 130" and a second secure member 140".

The plate 110" is composed of a plurality of plate-type longitudinal members disposed parallel to one another, and at both sides of a center in a cross-sectional direction of the plate 110", a concave groove 112 having a shape where the top, bottom, left and right thereof are all blocked, is formed along a longitudinal direction of the plate 110", and on a surface of the plate 110" facing the support frame 120", a plurality of penetration holes 111 are formed to communicate with the concave groove 112. Such a plate 110" is illustrated to be disposed above the support frame 120" and below the support frame 120", respectively, but it is possible to dispose the plate 110" on only the upper surface of the support frame 120", instead.

The support frame 120" is disposed in a direction intersecting the plate 110" so as to support the plurality of plates 110". The support frame 120" may be provided in plurality so as to stably support the plurality of plates 110", and may be disposed at intervals along the longitudinal direction of the plate 110"

On the support frame 120", the seating surface 121 is formed against which the plate 110" is closely supported, and the insertion hole 122 that communicates with the inner space 123 of the support frame 120" is formed on the seating surface 121 at the position corresponding to the penetration hole 111. In the inner space 123, a guiding protrusion 124" for guiding the second axis Y direction movement of the second secure member 140" is formed along the longitudinal direction.

The first secure member 130" includes an insertion unit 131 that is inserted into the insertion hole 122 to secure the plate 110" to the support frame 120", and a head 133 that is provided at a rear end of the insertion unit 131 to secure the insertion unit 131 to the plate 110", and at both side surfaces of the insertion unit 131, an insertion groove 132 is concavely formed along the longitudinal direction of the support frame 120".

Further, the first secure member 130" has the head 133 and the insertion unit 131 formed in a separated form, and the head 133 is provided with a female screw 133*a*, and the insertion unit 131 is provided with a male screw 131*a* that screw-engages with the female screw 133*a*, and in a state where the head 133 is inserted into the concave groove 112 of the plate 110", as the male screw 131*a* of the insertion unit 131 engages with the female screw 133*a* of the head 133 through the penetration hole 111 of the plate 110", the first secure member 130" may be firmly secured to the plate 110" side. Meanwhile, in the process of inserting the head 133 into the concave groove 112, it is desirable to guide the insertion position of the head 133 through a separate guide such that the female screw 133*a* of the head 133 coincides with the penetration hole 111 of the plate 110".

The head 133 is inserted into the concave groove 112 having a shape where the top, bottom, left and right thereof are all blocked, and thus movement in the second axis Y direction and the third axis Z direction is limited, and as the insertion unit 131 penetrates through the penetration hole 111 and is fastened to the female screw 133*a* of the head 133, its movement in the first axis X direction is limited.

The second secure member 140" is formed in the shape of a bar that extends in the longitudinal direction of the support frame 120", and in a state where the second secure member 140" is inserted into the inner space 123 of the support frame 120", its movement in the second axis Y direction is guided along the formed guiding protrusion 124", and the second secure member 140" may secure or release the insertion unit 131 of the first secure member 130" according to the axis direction movement position.

Specifically, on a plate surface of the second secure member 140", a penetration hole 111 is formed into which the insertion unit 131 of the first secure member 130" may be penetratingly inserted. At one side of such a penetration hole 111, an insertion area 141*a* is formed, which the insertion unit 131 of the first secure member 130" may be inserted into or separated from in the third axis Z direction, and at another side of the penetration hole 111, a secure area 141*b* is formed, which the insertion unit 131 of the first secure member 130" may be secured to, and at both sides of the secure area 141*b*, a secure protrusion 142 is provided, which may be inserted into the insertion groove 132 formed at both sides of the insertion unit 131.

Hereinafter, operations of the third embodiment of the assembly type pallet mentioned above will be described.

Figure 17:
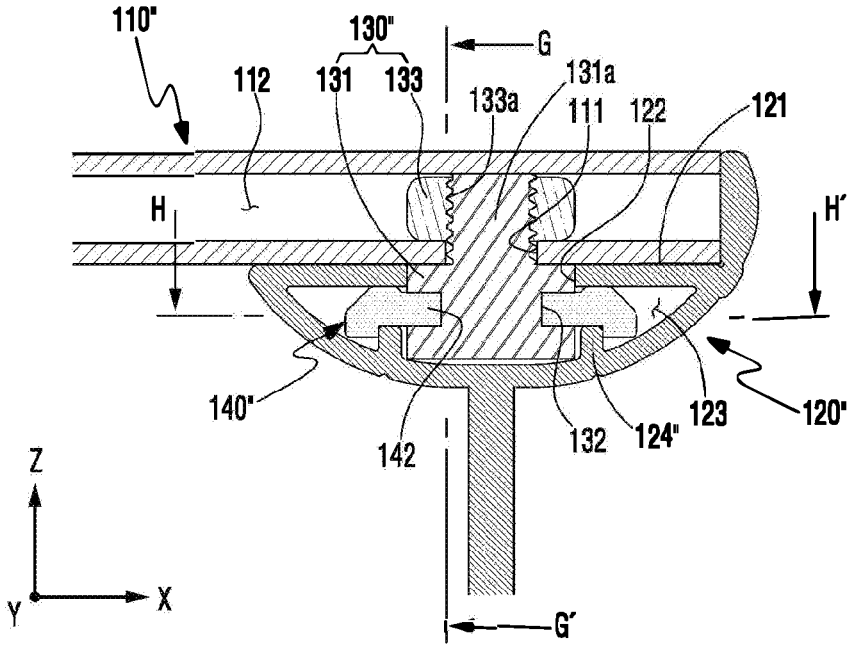
FIG. 17 is a cross-sectional view of part "F" of FIG. 15.
Figure 18:
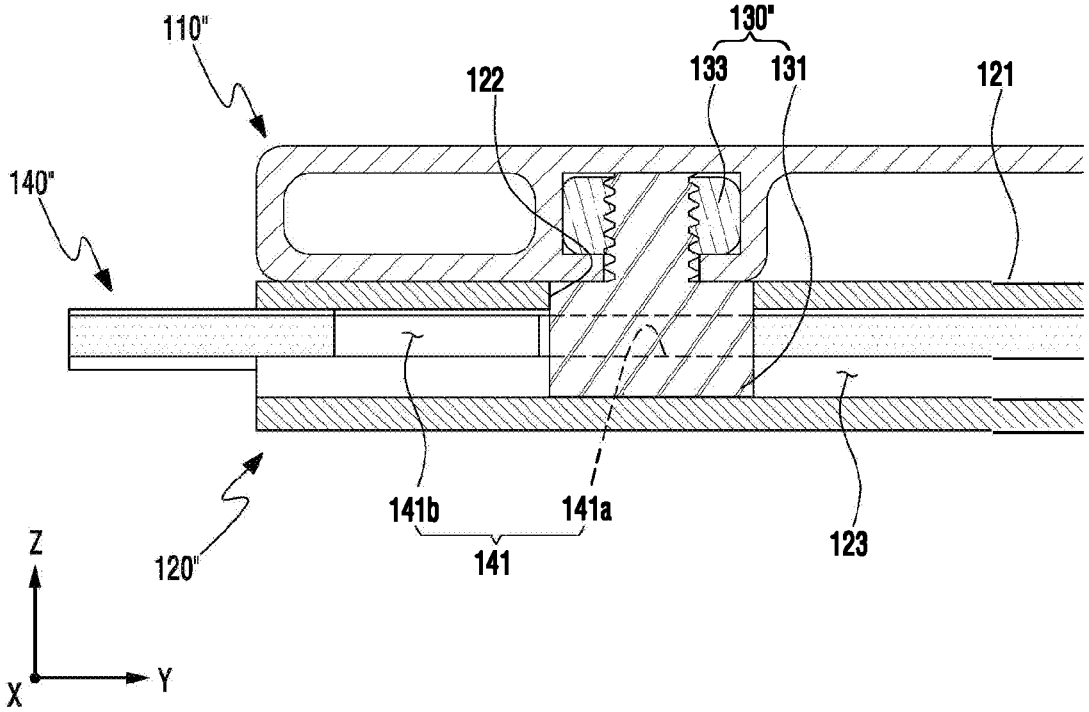
FIGS. 18 to 19 are views illustrating a state where the second secure member moved to a release position according to a third embodiment of the present disclosure.
Figure 19:
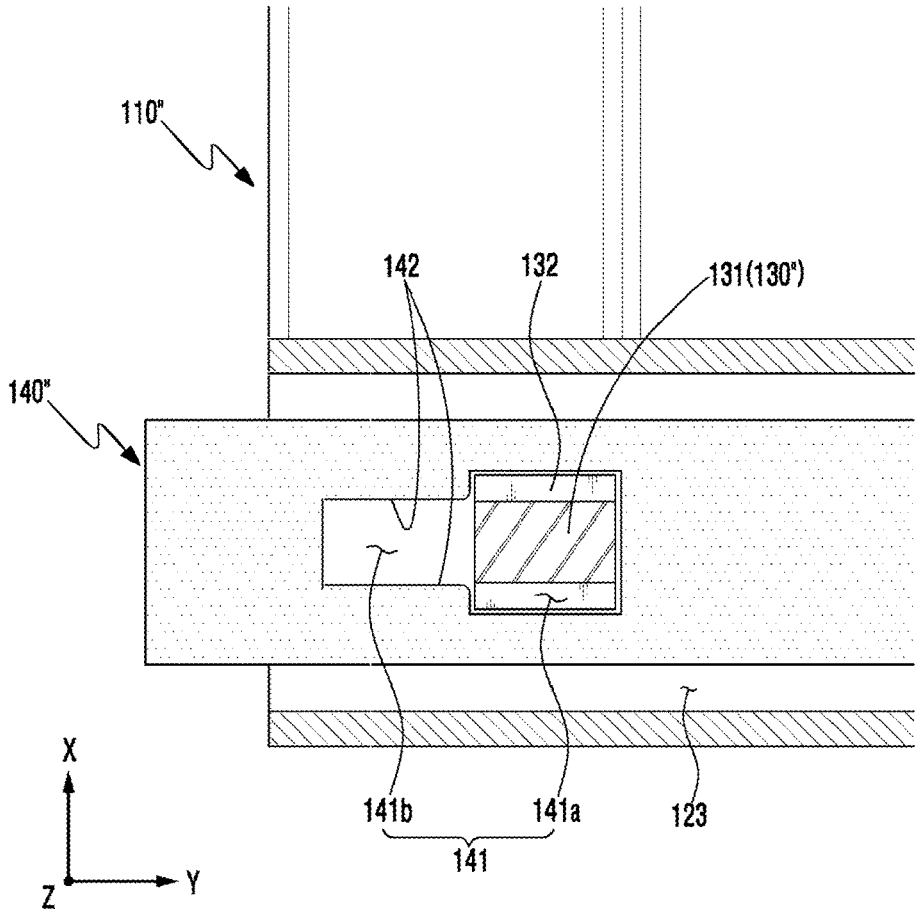
Figure 20:
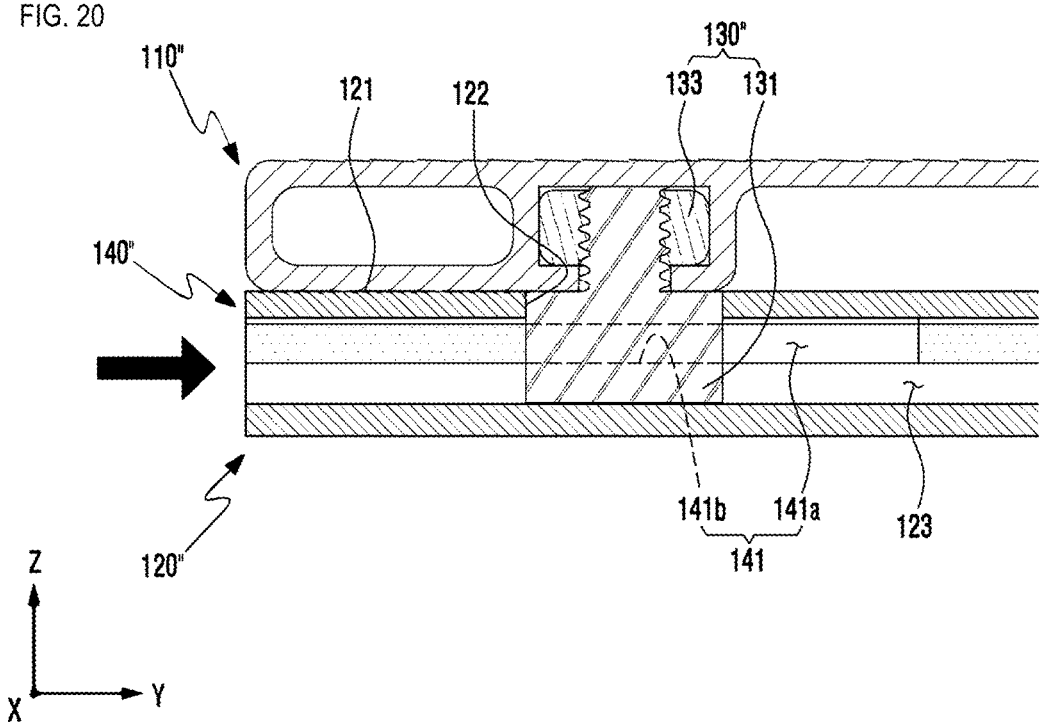
FIGS. 20 to 21 are views illustrating a state where the second secure member moved to a secure position according to a third embodiment of the present disclosure.
Figure 21:
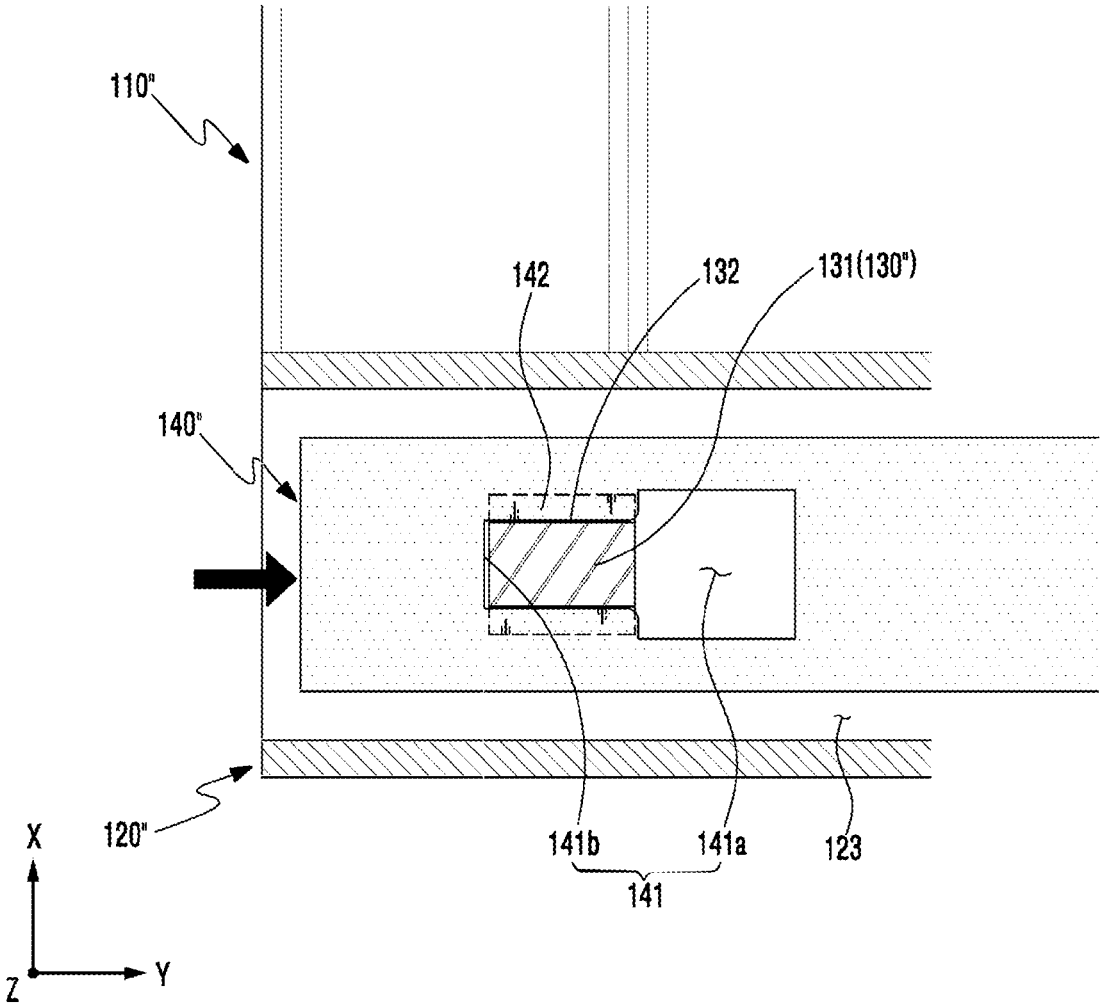

Of the attached drawings, FIG. 17 is a cross-sectional view of part "F" of FIG. 15, FIGS. 18 to 19 are views illustrating a state where the second secure member moved to a release position according to a third embodiment of the present disclosure, and FIGS. 20 to 21 are views illustrating a state where the second secure member moved to a secure position according to the third embodiment of the present disclosure.

As illustrated in FIG. 17, the plate 110" is disposed in the first axis X direction, and the support frame 120" is disposed from the lower portion of the plate 110" towards the second axis Y direction, to intersect the plate 110", and a lower surface of the plate 110" is closely supported against the seating surface 121 of the support frame 120".

As for the first secure member 130", in a state where the head 133 is inserted into the concave groove 112 of the plate 110", as the male screw 131*a* of the insertion unit 131 engages with the female screw 133*a* of the head 133 through the penetration hole 111 of the plate 110", the first secure member 130" is firmly secured to the plate 110".

In a state where the plate 110" is supported against the seating surface 121 of the support frame 120", the insertion unit 131 of the first secure member 130" is inserted into the insertion hole 122 of the support frame 120" and the penetration hole 111 of the second secure member 140", and thus relative movement of the plate 110" from the support frame 120" towards the first axis X direction and the second axis Y direction is limited. Next, in a state of being inserted into the inner space 123 of the support frame 120", the insertion protrusion 142 of the second secure member 140" is inserted into the insertion groove 132 at both sides of the insertion unit 131 of the first secure member 130", and thus relative movement of the plate 110" from the support frame 120" towards the third axis X direction is limited.

That is, by assembling the first secure member 130" and the second secure member 140" in a simple fitting method, it is possible to firmly maintain the assembled state of the plate 110" and the support frame 120".

Hereinafter, a process of assembling the first secure member 130" and the second secure member 140" will be described.

First, FIG. 18 illustrates a cross-sectional view cut along line G-G' of FIG. 17, and FIG. 19 illustrates a cross-sectional view cut along line H-H' of FIG. 17.

As illustrated in FIGS. 18 to 19, in a state where the head 133 is inserted into the concave groove 112 of the plate 110", as the male screw 131*a* of the insertion unit 131 engages with the female screw 133*a* of the head through the penetration hole 111 of the plate 110", the first secure member 130" is firmly secured. That is, the head 133 is inserted into the concave groove 112 having a shape where the top, bottom, left and right thereof are all blocked, and thus its movement towards the second axis Y direction and the third axis Z direction is limited, and as the male screw 131*a* penetrates through the penetration hole 111 and is fastened to the head 133, movement of the insertion unit 131 towards the first axis X direction is limited, and thus the first secure member 130" is firmly secured to the plate 110".

In a state where the second secure member 140" is inserted into the inner space 123 of the support frame 120", its movement towards the second axis Y direction is guided by the guiding protrusion 124" provided in the inner space 123, and its movement towards the first axis X direction and the third axis Z direction is limited.

While going back and forth between a secure position and a release position along the second axis Y direction within the inner space 123 of the support frame 120", the second secure member 140" may secure or release the insertion unit 131 of the first secure member 130" penetratingly inserted into the secure hole 141.

That is, at the release position, in order for the insertion unit 131 of the first secure member 130" to penetrate through the secure hole 141 of the second secure member 140", the insertion area 141*a* of the secure hole 141 formed on the plate surface of the second secure member 140" is disposed at the position (release position) communicating with the insertion hole 122 of the support frame 120", wherein an end of the second secure member 140" protruding from the end of the support frame 120".

As such, in a state where the first secure member 130" is assembled to the plate 110" and the second secure member 140" is assembled to the support plate 110", when a lower surface of the plate 110" disposed in a direction intersecting the support frame 120" rests on the seating surface 121 at an upper side of the support frame 120", the insertion unit 131 of the first secure member 130" secured to the plate 110" penetrates through the insertion area 141*a* provided in the secure hole 141 of the second secure member 140".

Next, as illustrated in FIGS. 20 and 21, to one side of the insertion area 141*a* of the secure hole 141, a secure area 141*b* is connected, and when the second secure member 140" is pressurized in the second axis direction and moved to the secure position, the insertion unit 131 of the first secure member 130" is disposed within the secure area 141*b* of the secure hole 141. Here, as the secure protrusion 142 formed at both sides of the secure area 141*b* are inserted into the insertion groove 132 formed at both sides of the insertion unit 131, the insertion unit 131 of the first secure member 130" is prevented from being separated towards the insertion side.

Therefore, by assembling the first secure member 130" and the second secure member 140" in a simple fitting method, the assembled state of the plate 110" and the support frame 120" may be firmly maintained.

The scope of protection of the present invention is not limited to the aforementioned embodiments but may be implemented in various forms of embodiments within the scope of the claims attached hereto. The scope of protection of the present invention is interpreted by the following claims, and all technical ideas within the scope equivalent thereto should be construed as being included in the scope of the present invention.

INDUSTRIAL AVAILABILITY

The present invention relates to an assembly type pallet, and more particularly, to an assembly type pallet that may be assembled quickly and firmly using a secure member that may be secured in a simple secure method.

What is claimed is:

1. An assembly type pallet, comprising:

a plurality of plates disposed side by side to each another;

a plurality of support frames that are disposed in a direction intersecting the plates to support a lower portion of the plates, an inside of the support frame being provided with an inner space along a longitudinal direction, an upper surface of the support frame being provided with a seating surface against which a lower surface of the plates is supported, and the seating surface being provided with an insertion hole communicating with the inner space;

a first secure member that is disposed on the lower surface of the plates and that is provided with an insertion unit which is inserted into the insertion hole of the support frame to secure the plates to the support frame; and a second secure member that is inserted into the inner space of the support frame to secure the insertion unit of the first secure member to the support frame, wherein side walls of the support frame contacting the inner space closely contact both sides of the insertion unit of the first secure member, wherein the side wall of the support frame is provided with a guiding groove concavely formed along a longitudinal direction and into which one side of the second secure member is inserted, and the insertion unit of the first secure member is provided with an insertion groove concavely formed and into which another side of the second secure member is inserted.

2. The assembly type pallet according to claim 1, wherein the second secure member extends along the longitudinal direction of the support frame to simultaneously secure a plurality of first secure members being inserted into the support frame.

3. The assembly type pallet according to claim 1, wherein the plates are provided with a penetration hole through which the first secure member penetrates, and a rear end of the insertion unit of the first secure member is provided with a head that is supported against the plates.

4. The assembly type pallet according to claim 3, wherein an upper surface of the plates is provided with a concave groove that is concavely formed and into which the head of the first secure member is accommodated, and both sides of the concave groove closely contact both sides of the head.

5. The assembly type pallet according to claim 3, wherein the insertion unit and the head are formed separately, the head is inserted into and supported against the concave groove provided in the plates, and the insertion unit penetrates the penetration hole of the plates and is assembled to the head.

6. The assembly type pallet according to claim 5, wherein the concave groove is formed along the longitudinal direction of the plate inside the plates.

7. An assembly type pallet, comprising:

a plurality of plates disposed side by side to each another;

a plurality of support frames that are disposed in a direction intersecting the plates to support a lower portion of the plates, an inside of the support frame being provided with an inner space along a longitudinal direction, an upper surface of the support frame being provided with a seating surface against which a lower surface of the plates is supported, and the seating surface being provided with an insertion hole communicating with the inner space;

a first secure member that is disposed on the lower surface of the plates and that is provided with an insertion unit which is inserted into the insertion hole of the support frame to secure the plates to the support frame; and a second secure member that is inserted into the inner space of the support frame to secure the insertion unit of the first secure member to the support frame, wherein the second secure member is provided with a secure hole that may selectively secure the insertion unit of the first secure member according to a position of the second secure member, wherein at one side of the secure hole, an insertion area is formed, into which the insertion unit of the first secure member can be penetratingly inserted, and at another side of the secure hole, a secure area is formed, which grips both sides of the insertion unit of the first secure member to secure the insertion unit.

8. The assembly type pallet according to claim 7, wherein the secure area has a trapezoid shape where a distance between both sides of the secure area gradually decreases.

9. The assembly type pallet according to claim 8, wherein a side wall of the support frame is provided with a guiding groove that guides movement of the second secure member.

10. The assembly type pallet according to claim 7, wherein both sides of the insertion unit are provided with an insertion groove along a longitudinal direction of the second secure member, and the secure area is provided with a secure protrusion inserted into the insertion groove.

11. The assembly type pallet according to claim 7, wherein the second secure member extends along the longitudinal direction of the support frame to simultaneously secure a plurality of first secure members being inserted into the support frame.

12. The assembly type pallet according to claim 7, wherein the plates are provided with a penetration hole through which the first secure member penetrates, and a rear end of the insertion unit of the first secure member is provided with a head that is supported against the plates.

* * * * *